US007168977B2

(12) United States Patent
Reibke et al.

(10) Patent No.: US 7,168,977 B2
(45) Date of Patent: Jan. 30, 2007

(54) PLUG-IN JUMPER FOR ELECTRICAL JUNCTION AND/OR CONNECTING TERMINALS AND ELECTRICAL JUNCTION AND/OR CONNECTING TERMINAL

(75) Inventors: Heinz Reibke, Bad Salzuflen (DE); Dirk Goerlitzer, Hessisch Oldendorf (DE); Hartmut Follmann, Extertal (DE); Stefan Schroeder, Steinheim (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 10/915,715

(22) Filed: Aug. 11, 2004

(65) Prior Publication Data

US 2005/0095904 A1 May 5, 2005

(30) Foreign Application Priority Data

Aug. 13, 2003 (DE) ..... 103 37 400
Oct. 31, 2003 (DE) ..... 103 51 289

(51) Int. Cl.
*H01R 31/08* (2006.01)
*H01R 11/09* (2006.01)

(52) U.S. Cl. ..... 439/507; 439/723

(58) Field of Classification Search ..... 439/507, 439/715, 716, 835, 856, 857, 723, 787
See application file for complete search history.

(56) References Cited

U.S. PATENT DOCUMENTS 3,208,034 A * 9/1965 Jensen et al. ..... 439/684
3,518,612 A * 6/1970 Axford et al. ..... 439/507
5,004,426 A * 4/1991 Barnett ..... 439/82
5,322,458 A * 6/1994 Hennemann et al. ..... 439/723
5,374,204 A * 12/1994 Foley et al. ..... 439/751
6,280,259 B1 8/2001 Stollburges
2005/0095904 A1* 5/2005 Reibke et al. ..... 439/507

FOREIGN PATENT DOCUMENTS

DE 83 11 219.7 12/1983
DE 42 23 540 A1 1/1994
DE 44 11 306 C1 5/1995
DE 195 33 992 C1 3/1997

OTHER PUBLICATIONS

Patent Abstracts of Japan, "Connection Structure of Electric Component and Electric Wire", Publication No. 2002 243 463 A, Publication Date Nov. 29, 2002.

* cited by examiner

*Primary Examiner*—James R. Harvey
(74) *Attorney, Agent, or Firm*—David S. Safran

(57) ABSTRACT

A plug-in jumper for terminal blocks is provided for elastic engagement in openings in busbars and for electrical contact-making of the busbars of at least two junction and/or connecting terminals. The plug-in jumper includes a jumper bar having a bar strip and several plugs which are connected to the bar strip. Each plug has at least two contact legs located essentially parallel to one another, of which at least one is made elastic. The plug-in jumper makes it possible to electrically interconnect different busbars of different terminal blocks since the plugs have two contact areas which are located on top of one another for contact-making of two busbars of two junction and/or connecting terminals which are located next to one another, wherein the two busbars are located on a different planes.

14 Claims, 8 Drawing Sheets

PLUG-IN JUMPER FOR ELECTRICAL JUNCTION AND/OR CONNECTING TERMINALS AND ELECTRICAL JUNCTION AND/OR CONNECTING TERMINAL

BACKGROUND OF THE INVENTION

1. Field of Invention

The invention relates to a plug-in jumper for electrical junction and/or connecting terminals, especially terminal blocks, for elastic engagement in openings in busbars and for electrical contact-making of busbars of at least two junction and/or connecting terminals, with a jumper bar, wherein the jumper bar includes a bar strip and several plugs connected to the bar strip and each plug includes at least two contact legs located essentially parallel to one another, of which at least one is made elastic. In addition, the invention relates to electrical junction and/or connecting terminals, especially terminal blocks, with a housing, with at least one busbar, with at least two connecting elements and with a detachable plug-in jumper.

2. Description of Related Art

Electrical junction and/or connecting terminals, especially terminal blocks, have been known for decades and are used in the millions in the wiring of electrical systems and devices. The terminals are generally locked onto mounting rails which are often located in a plurality in a switchgear cabinet. In terminal blocks, the conductor terminal elements are mainly screw terminals or tension spring terminals. The clamping principle in tension spring terminals is similar to that of screw technology. While in a screw terminal a tension sleeve pulls the conductor against the busbar by actuation of the terminal screw, in a tension spring terminal, this task is assumed by the tension spring. In addition, however, there are also terminal blocks with conductor terminal elements with cutting blades which cut the insulation of the inserted conductor and make contact with the core of the conductor.

Electrical terminal blocks are generally connecting terminals so that they have at least two conductor terminal elements which are electrically connected to one another via an electrically conductive connecting bar, that is, the busbar. These terminal blocks are also called feed-through terminals. In addition to this basic type of terminal block, there is moreover a host of different types of terminal blocks which are specially adapted to the respective applications. Examples here are two-tier, three-tier or four-tier terminals and three-conductor or four-conductor terminals which then each have a correspondingly larger number of conductor terminal elements. Two-tier, three-tier or four-tier terminals which are generally also called tiered terminals, have thus two, three or four busbars which are located on top of one another in different planes and which each electrically connect two conductor terminal elements at a time to one another.

To reduce the wiring cost for terminal blocks which are locked on a mounting rail next to one another, it is known to use plug-in jumpers with a corresponding number of plugs. The plugs of the plug-in jumper are inserted in the corresponding openings in the busbars of the individual terminal blocks, by which the individual busbars or the individual terminal blocks are electrically connected to one another.

The above described conventional plug-in jumper and/or electrical junction and/or connecting terminal is disclosed in, for example, German Patent 44 11 306 C1. The known plug-in jumper is characterized in that it has two jumper bar segments which are located next to one another and on which one contact leg at a time per plug is made, the spring loading of the plug taking place parallel to the lengthwise direction of the bar strip. The two jumper bar sections can be simple stampings so that the known plug-in jumper can be produced very easily.

German Patent application 42 23 540 A1 likewise discloses a plug-in jumper in which however the spring forces of the contact legs upon insertion into the opening of the busbars are aligned transversely to the lengthwise direction of the bar strip. It is however common to the two known plug-in jumpers that they can only be used when the same types of terminal blocks are arranged in a row next to one another. For example, with these plug-in jumpers several identical feed-through terminals can be electrically connected to one another.

German Patent 195 33 992 C1 discloses an electrical tiered terminal with two busbars which are located on top of one another, in which an electrical connection of the two busbars is possible by means of a plug-in jumper having only one plug which can be inserted into the two plug openings which are flush with one another in the busbars. In particular, the known plug-in jumper consists of two spring contacts which adjoin one another flat and which, in the area of their top contact zone which interacts with the upper busbar, have offsets pointed in opposite directions to one another. When the plug-in jumper is inserted into the two openings of the two busbars, this leads to elastic spreading of the two spring contacts in the opening of the top and the bottom busbar. The spreading takes place in opposite directions resulting in the plug-in jumper making contact with the two busbars. Thus an electrical connection of two busbars of a terminal block can be accomplished by this known plug-in jumper.

SUMMARY OF THE INVENTION

The object of this invention is to provide a plug-in jumper for electrical junction and/or connecting terminals which makes it possible to interconnect even different types of terminal blocks, especially those terminal blocks with different conductor terminal elements.

The above object, and other objects, are achieved by providing a plug-in jumper wherein the plugs have two contact areas located on top of one another for contact-making of two busbars of two electrical junction and/or connecting terminals which are located on top of one another, wherein the two busbars are located on a different plane. In contrast to the plug-in jumper disclosed in German Patent 44 11 306 C1, the plug-in jumper of the present invention allows the terminal blocks, having different conductor terminal elements, to also be electrically connected to one another. The busbars, connecting the terminal elements of the terminal blocks, are located on different planes.

Based on the different connection principles, specifically in conventional terminal blocks in which the conductor terminal elements are made as screw terminals, the busbars are located higher than in those terminal blocks in which the conductor terminal elements are made as tension spring terminals or as cutting blades. The relative height difference of the busbars relates to the distance of the individual busbars to the mounting rails for two terminal blocks which are locked next to one another on a mounting rail. By providing at least two contact areas located on top of one another on each plug of the plug-in jumper, it is thus possible for one plug with its lower contact area to be inserted into the opening of the busbar of a first terminal block, while at the same time another plug of the plug-in jumper with its upper contact area is inserted in the opening of the busbar of a second terminal block with a busbar which lies in another plane. Thus, with one plug-in jumper two busbars of two different terminal blocks, which busbars are located on different planes, can be electrically connected to one another.

According to one preferred embodiment of the invention, the plugs and the contact legs have different widths, the width of a plug being matched to the width of the busbar or to the width of the opening in the busbar. Generally, the individual contact legs of a plug are of the same width so that all contact legs of one plug are narrower than the contact legs of another plug. In this way, it is possible with the plug-in jumper of the present invention to interconnect even two or more terminal blocks which are designed for connection of conductors with different conductor cross sections. If conductors with a larger conductor cross section are to be connected to a terminal block, this terminal generally also has busbars with a greater width and thus also wider openings as a result of the higher current flowing over the thicker conductors.

According to one advantageous configuration of the plug-in jumper of the present invention, the jumper bar is made such that the spring forces of the plugs or contact legs are pointed parallel to the lengthwise direction of the bar strip upon insertion into the openings of the busbar and upon contact-making of the busbar. The principle of contact-making of a busbar thus corresponds essentially to the contact-making principle of the plug-in jumper known from German Patent 44 11 306 C1. In contrast to this known plug-in jumper, the plug-in jumper of the present invention however advantageously has three contact legs which are arranged essentially parallel to one another, of which at least the middle contact leg is made elastic. If only the middle contact leg is made elastic—and the two outer contact legs are made relatively stiff—twisting of the plug-in jumper perpendicular to the lengthwise direction of the bar strip and thus perpendicular to the lengthwise direction of the plug-in jumper is prevented, by which insertion of the plug-in jumper into a host of terminal blocks which are located next to one another is facilitated.

According to another advantageous embodiment of the plug-in jumper of the present invention, a lengthwise slot is made in at least one contact leg. In the above described preferred embodiment with three contact legs, at least the middle contact leg is provided with the lengthwise slot. The execution of the lengthwise slot reduces the reset force as a result of deflection of the contact leg upon insertion into the opening of the busbar, by which especially the insertion force in the upper contact area is reduced so that the insertion or push-through force through the opening of the upper busbar hardly differs from the insertion force into the opening in the lower busbar.

According to another advantageous embodiment of the plug-in jumper of the present invention, the contact legs underneath the lower contact area on at least one narrow side have a ramp bevel. In this way, the insertion of the contact leg into an opening of the lower busbar is further facilitated. Moreover, the lower contact area can be bordered to the top by a laterally projecting offset so that with the corresponding dimensioning of the opening, defined insertion of the plug-in jumper into the terminal block is ensured.

In the initially described electrical junction and/or connecting terminal with a busbar which has an opening for elastic engagement and electrical contact-making of the plug-in jumper, the objects of the present invention are achieved in that for a plug-in jumper which has a jumper bar with a bar strip and several plugs connected to the bar strip, the plugs have two contact areas which are located on top of one another for contact-making of two busbars of two electrical junction and/or connecting terminals which are located on top of one another, the two busbars being located on different planes.

It has been stated above that the plug-in jumper is made for electrical connection of two junction and/or connecting terminals which are located next to one another. It is, on the one hand, also naturally possible to interconnect clearly more than two junction and/or connecting terminals with the plug-in jumper. On the other hand, it is not necessary for the junction and/or connecting terminals which are to be electrically connected to one another to be located directly next to one another. In particular, it is also possible, with a plurality of terminal blocks locked on a mounting rail, to interconnect only a few specific ones, for example the first third, fourth, seventh and tenth terminal blocks by a correspondingly made plug-in jumper. In this plug-in jumper then the distances between the individual plugs are made accordingly, which can preferably be accomplished by removing the plugs corresponding to the terminal blocks which are not to be electrically connected to one another, for which, in the transition area between the bar strip and the individual plugs, the corresponding scored locations are provided.

In particular, there are a host of possibilities for embodying and developing the plug-in jumper of the present invention and the electrical junction and/or connecting terminal of the present invention, as discussed and recited throughout this specification.

DETAILED DESCRIPTION OF THE INVENTION

Figure 1:
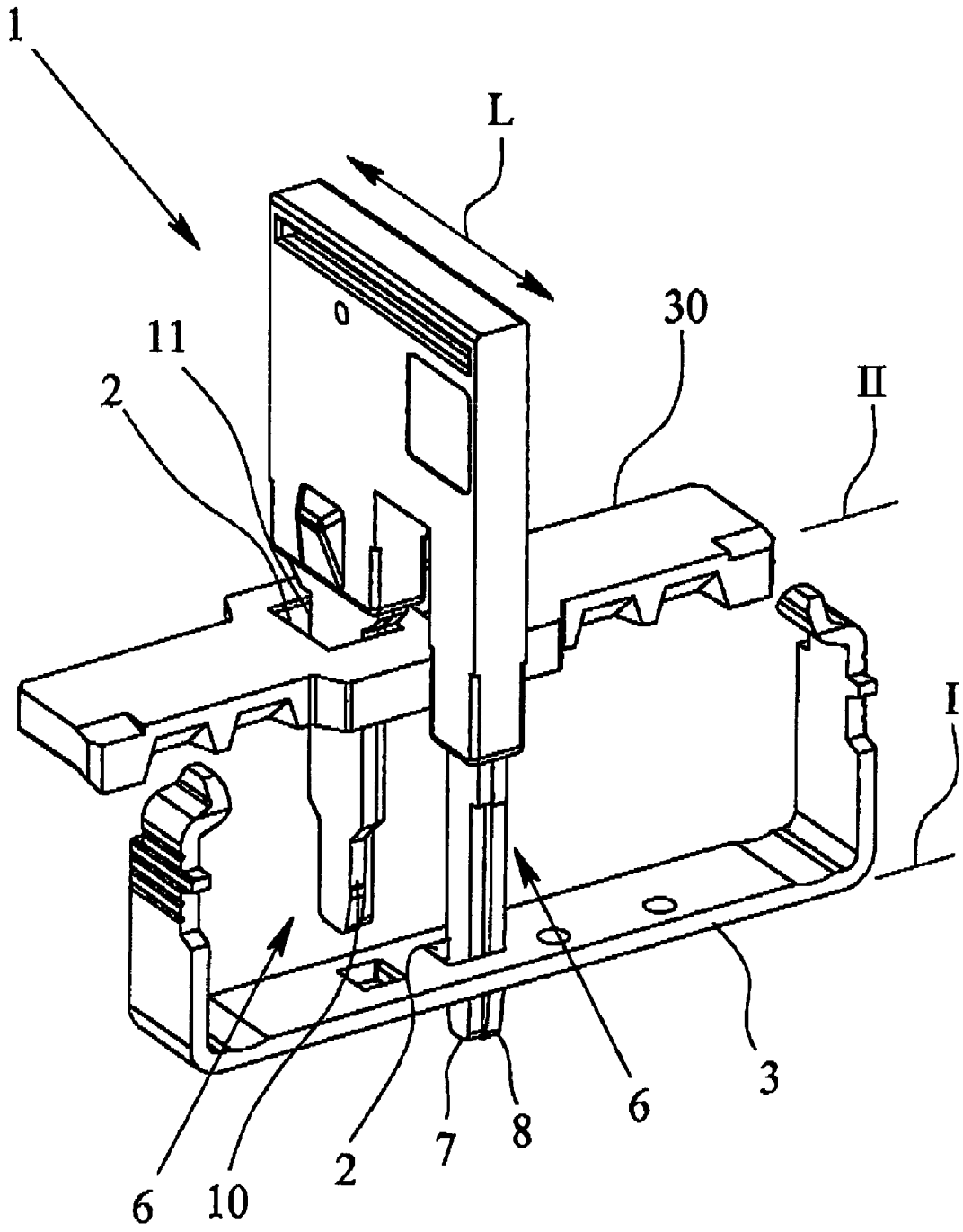
FIGS. 1, 2 and 3 show perspective views of various applications of a first embodiment of the plug-in jumper of the present invention, each together with two busbars of two terminal blocks.

The figures each show a plug-in jumper 1 for elastic engagement in openings 2 which are made in the busbars 3, 30 of electrical terminal blocks which are not shown here. Each busbar 3, 30 is located in the housing of the electrical terminal block and is used for electrically conductive connection of two connecting elements (not shown) of the terminal block. The busbar 3 is one which typically is used in terminal blocks with tension spring terminals, while the busbar 30 is one which is used in terminal blocks with screw terminals.

The plug-in jumper 1 has a jumper bar 4 (FIG. 6*b*) which is made comb-like and which has an upper bar strip 5 (FIG. 7) and a plurality of plugs 6 which are connected to the bar strip 5. In these embodiments, for jumper bar 4, only two plugs 6 are shown so that with the illustrated plug-in jumpers 1 also only two busbars 3, 30 of two terminal blocks can be electrically connected. Of course, more than two plugs can be provided.

Figure 2:
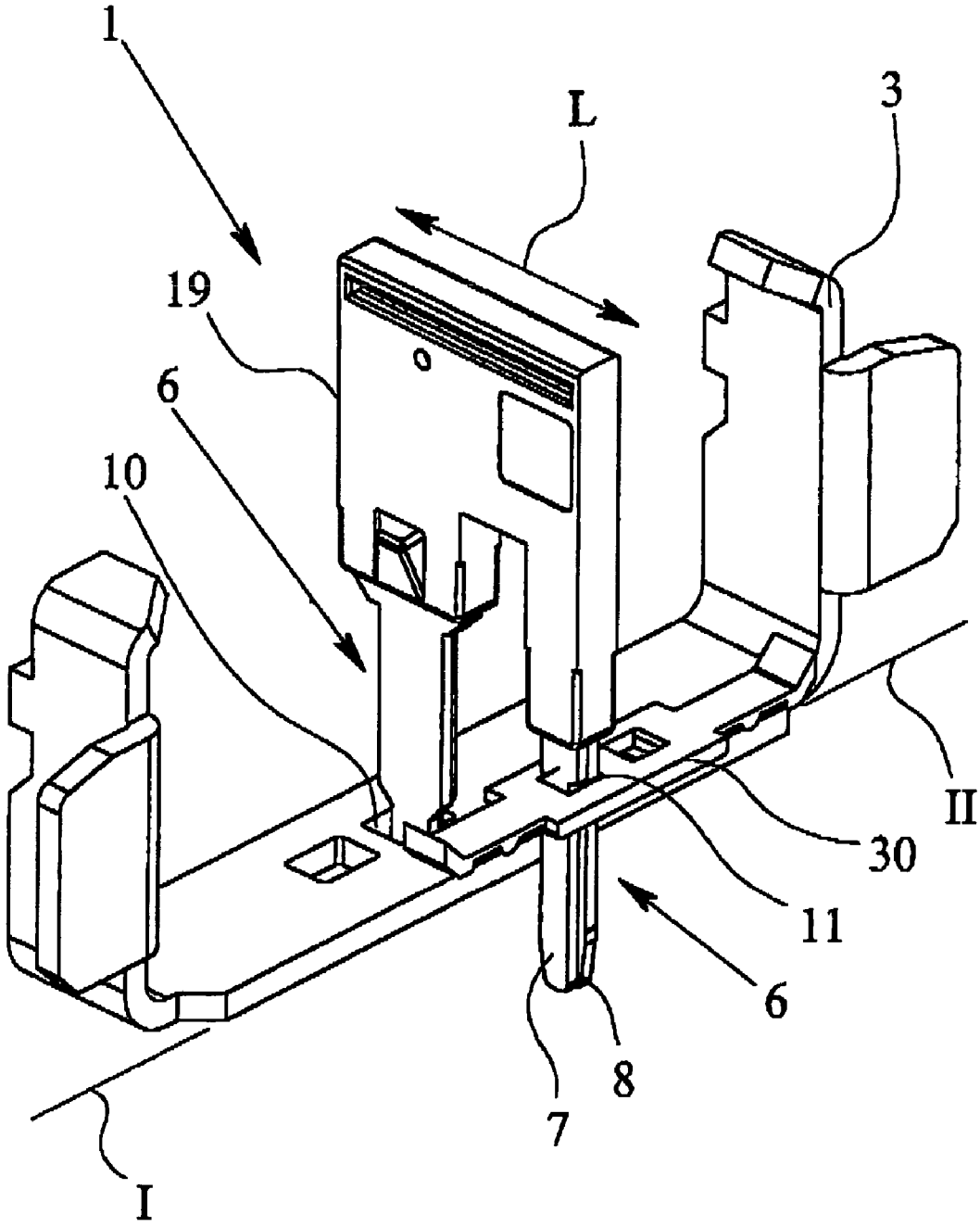
Figure 3:
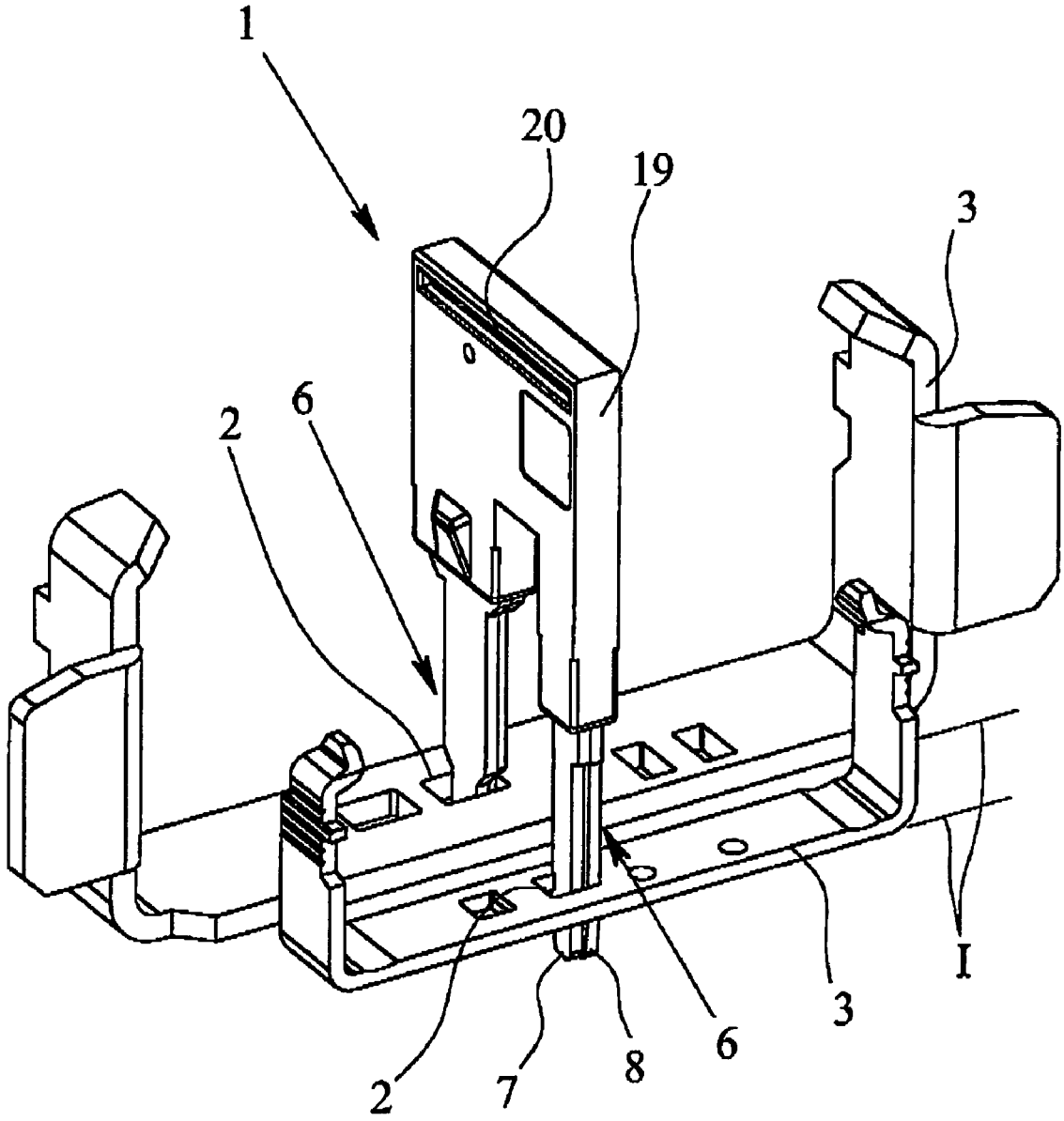

In the embodiments as shown in FIGS. 1–3, each plug 6 has two separate contact legs 7, 8. In contrast, in the embodiments shown in FIGS. 4–6 each plug 6 has three contact legs 7, 8, 9. If the plugs 6 of the plug-in jumpers 1 have only two contact legs 7, 8, preferably the two contact legs 7, 8 are made elastic. If the plugs 6 conversely have three contact legs 7, 8, 9, preferably only the middle contact leg 9 is made elastic, while the two outer contact legs 7, 8 are made relatively stiff.

It is common to all plugs 6 or all plug-in jumpers 1 that they have two contact areas 10, 11 which are located on top of one another so that there is the possibility of electrically interconnecting two busbars 3, 30 of two terminal blocks located next to one another, the two busbars being located on a different planes I, II. When the plugs 6 or the contact legs 7, 8, 9 are inserted into the openings 2 of the busbars 3, 30, the plugs 6 make contact in the lengthwise direction L of the bar strip 5. In doing so, the lengthwise direction L of the bar strip 5 or the plug-in jumper 1 runs roughly perpendicular to the lengthwise direction of the busbars 3, 30.

The above described direction of the spring forces, which arise due to the plugs 6 when the plugs 6 are inserted into the openings 2, is achieved in that the plugs 6 in the unloaded state, i.e., in the uninserted state, have a width which is greater than the width of the opening 2. This is achieved in that the contact legs 7, 8, 9 in the unloaded state are slightly offset to one another in the unloaded state in the lengthwise direction L. In the embodiment as shown in FIGS. 4–6*b*, only the middle contact leg 9, in the lengthwise direction L of the bar strip 5, is located slightly offset to the two outer contact legs 7, 8. This is achieved by deflecting only the middle contact leg 9 when the plug 6 is inserted into the opening 2 of the busbars 3, 30, by which twisting of the plug-in jumper 1 perpendicular to the lengthwise direction L is prevented. Thus, the insertion of the plug-in jumper 1 with a plurality of plugs 6 into a corresponding number of terminal blocks is facilitated.

The embodiments as shown in FIGS. 1–3 differ by the use of the plug-in jumper 1 which is identical at the time together with different busbars 3, 30, i.e. by use with different terminal blocks. In the embodiment as shown in FIG. 1, the plug 6, which is the front one in the plane of the drawing, is inserted into an opening 2 of a busbar 3 of a terminal block with tension spring terminals, while the plug 6, which is the rear one in the plane of the drawings, is inserted into an opening 2 of a busbar 30 of a terminal block with screw terminals. The busbar 3 is located on the lower plane I, while the busbar 30 is located on the upper plane II. Thus the busbar 3 makes contact in the lower contact area 10 of one plug 6 of the plug-in jumper 1, while the busbar 30 makes contact in the upper area 11 of the second plug 6 of the busbar 1.

In the second embodiment shown in FIG. 2, in contrast, for the plug 6, which is the front one in the plane of the drawings, the busbar 30 makes contact in the upper contact area 11, while for the plug 6, which is the rear one in the plane of the drawings, the busbar 3 makes contact in the lower contact area 10.

In the plug-in jumper 1, which is shown in FIGS. 1–3, the plug 6, which is the front one in the plane of the drawings, is somewhat narrower than the rear plug 6 since in the embodiments shown, the front busbar 3, 30 is likewise narrower than the rear busbar 30, 3. The width of the plug 6 is always matched to the width of the opening 2 in the busbar 3, 30. Since the different terminal blocks have only a limited number of different busbar widths, overall only a few plug-in jumpers 1 with different combinations of plug widths are necessary to be able to connect almost all types of different terminal blocks to one another.

Figure 4:
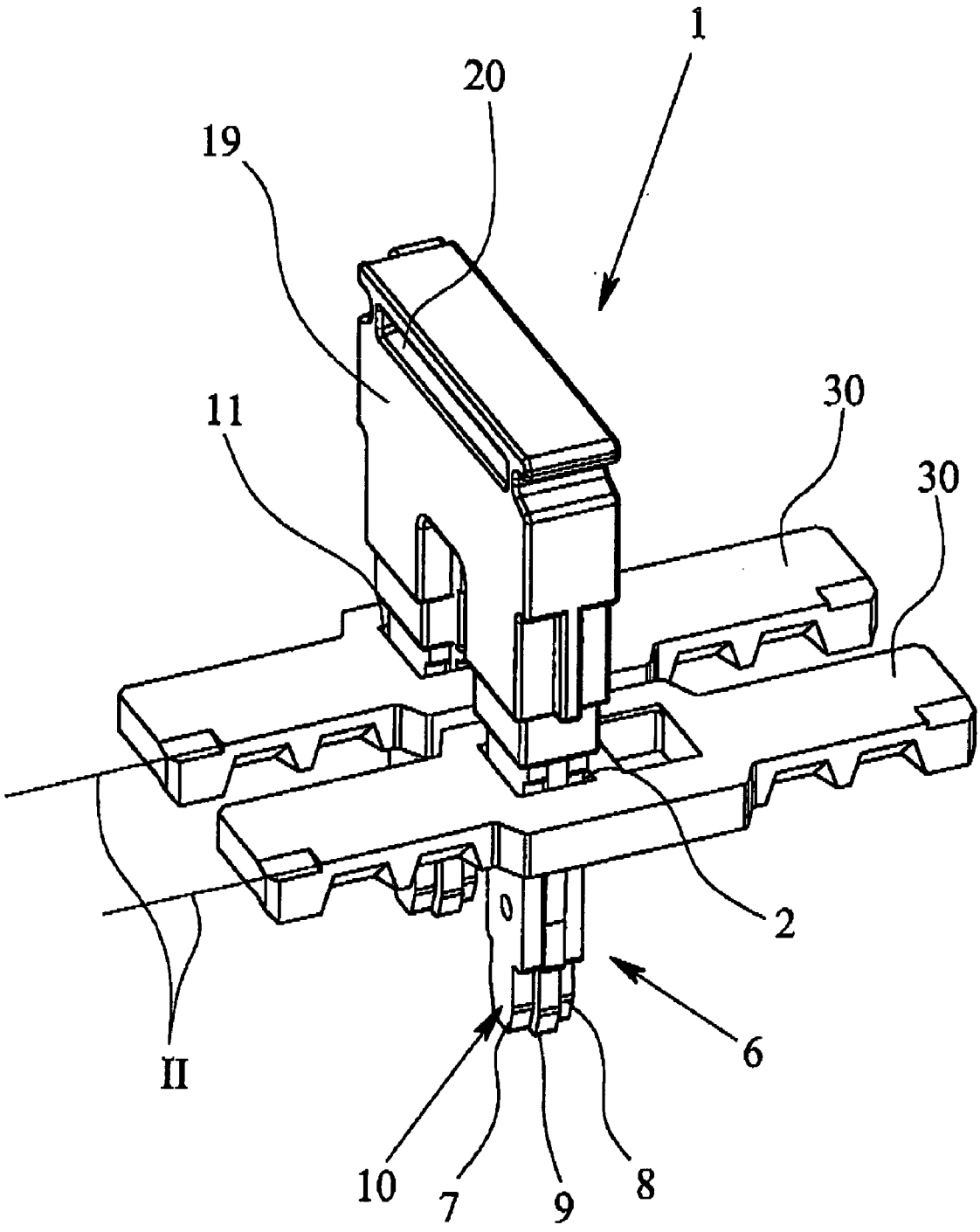
FIGS. 4 and 5 show perspective views of two applications of a second embodiment of the plug-in jumper of the present invention, each together with two busbars of two terminal blocks.
Figure 5:
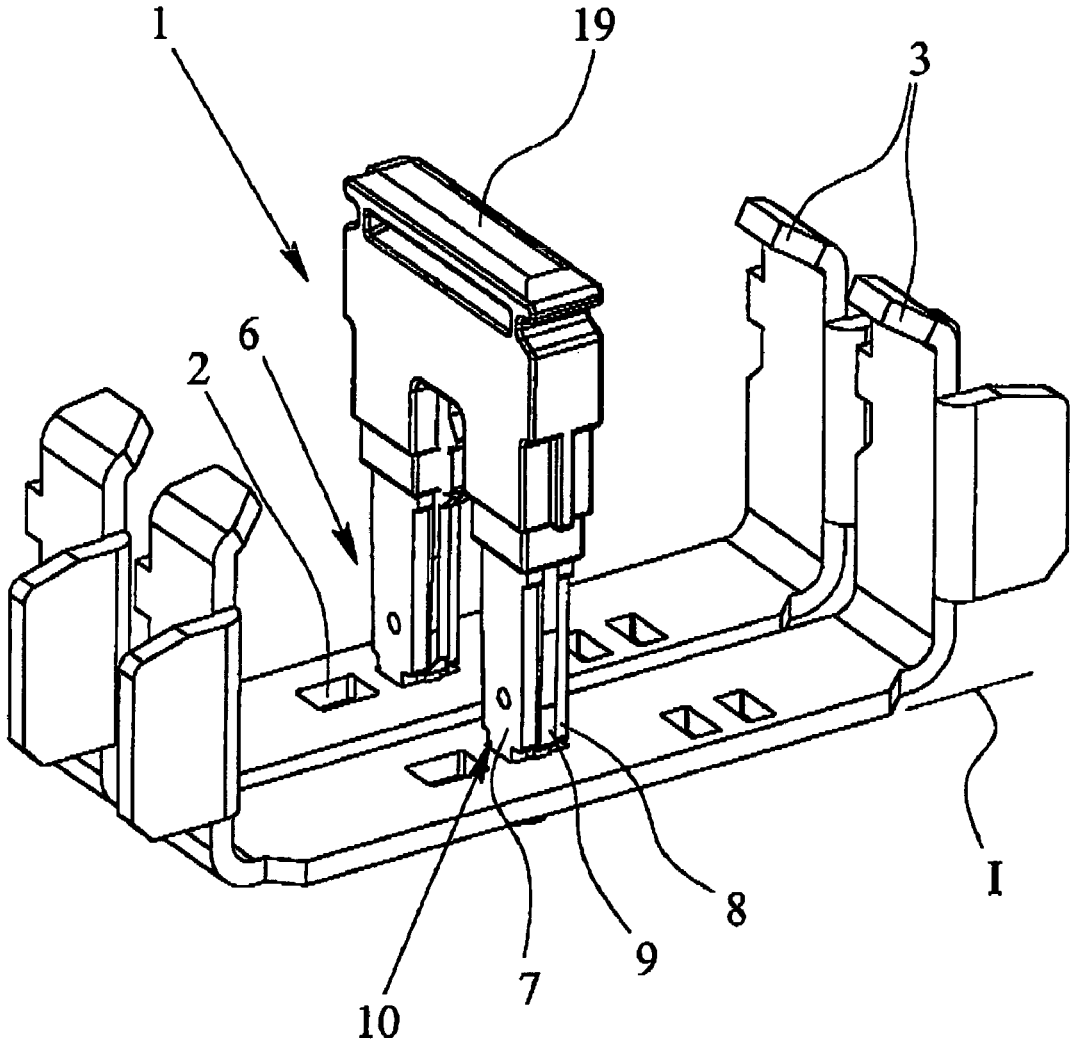

FIGS. 3–5 show embodiments in which the busbars 3, 30 both make contact with the plugs 6 in the lower contact area 10 or both with the plugs 6 in the upper contact area 11. Overall, because each plug 6 has two contact areas 10, 11 which are located on top of one another, it becomes possible to electrically interconnect different busbars 3, 30 and thus different terminal block types by the plug-in jumper 1.

Figure 7:
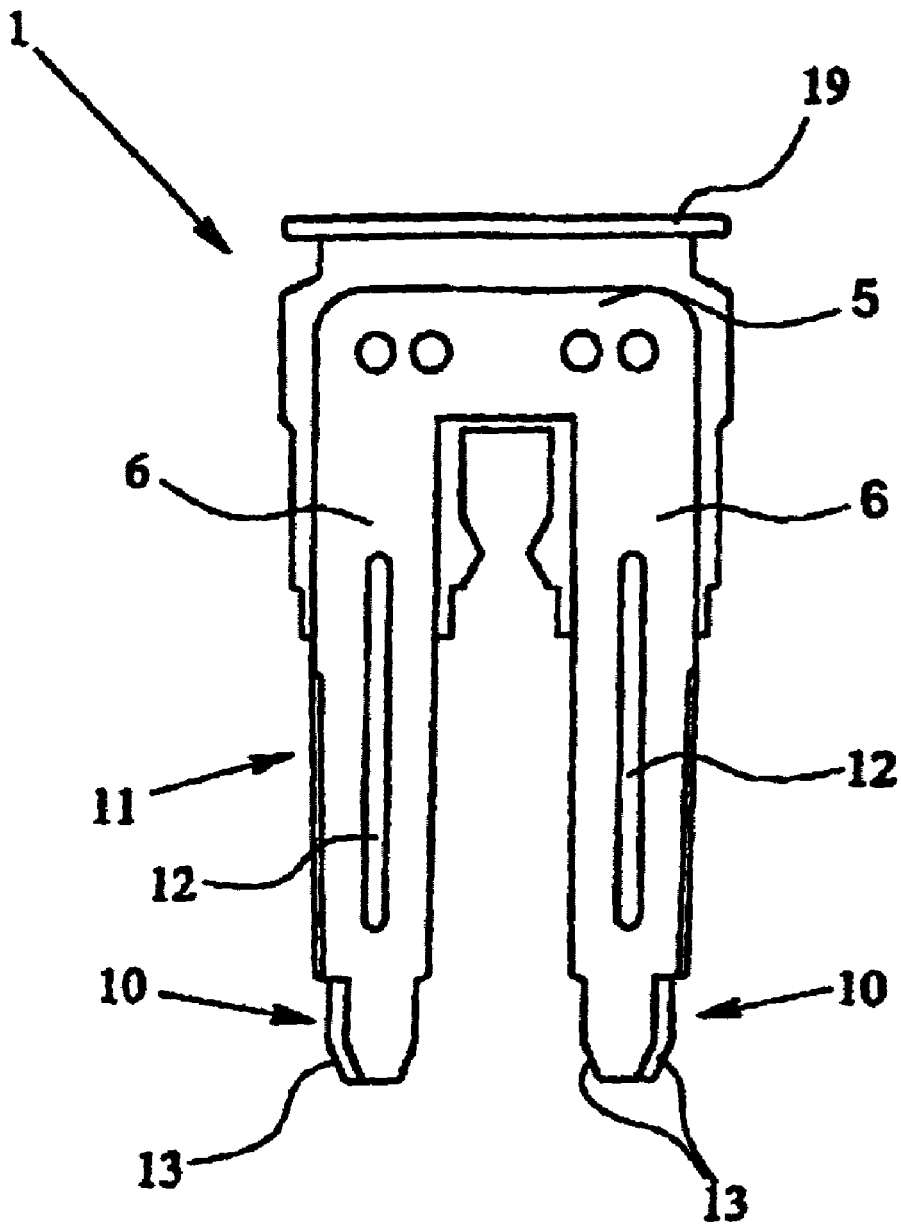
FIG. 7 shows an individual view of a plug-in jumper of the present invention from the front.

FIG. 7 shows that at least the middle contact leg 9 has one lengthwise slot 12. The lengthwise slot 12 extends from the area roughly above the lower contact area 10 to the area somewhat above the upper contact area 11. By the execution of the slot 12 in the contact leg 9, the reset force of the contact leg 9 is somewhat reduced, by which the required force is reduced when the plug 6 is pushed through the opening 2 of a busbar 30 in the upper plane II. With the corresponding dimensioning of the lengthwise slot 12, thus an insertion force can be achieved which is essentially constant, regardless of whether a plug 6 is inserted into an opening 2 of a busbar 3 in the lower plane I or into an opening 2 of a busbar 30 in the upper plane II.

The contact legs 7, 8, 9 are made such that their width B is greater than their thickness D. In this way, on the one hand, a relatively narrow plug-in jumper 1 can be accomplished. On the other hand, relatively large spring forces arise when the contact legs 7, 8, 9 are loaded in the lengthwise direction L of the bar strip 5, so that sufficient contact force is ensured. In order to facilitate the insertion of the plugs 6 into the openings 2 of the busbars 3, 30, the contact legs 7, 8, 9, underneath the lower contact area 10 on at least one narrow side, have a ramp bevel 13.

Figure 6A:
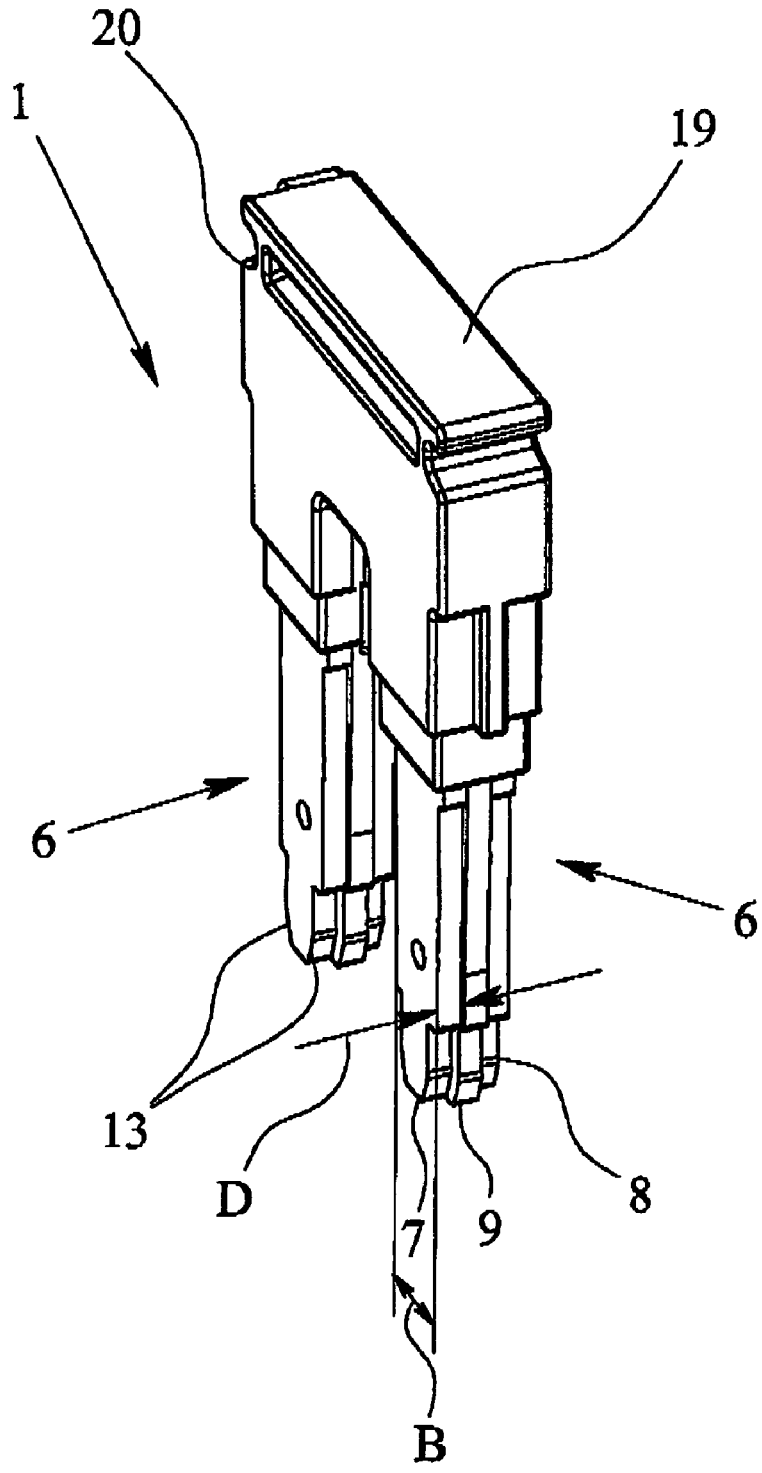
FIG. 6*a* shows a perspective individual view of the plug-in jumper of the present invention.
Figure 6B:
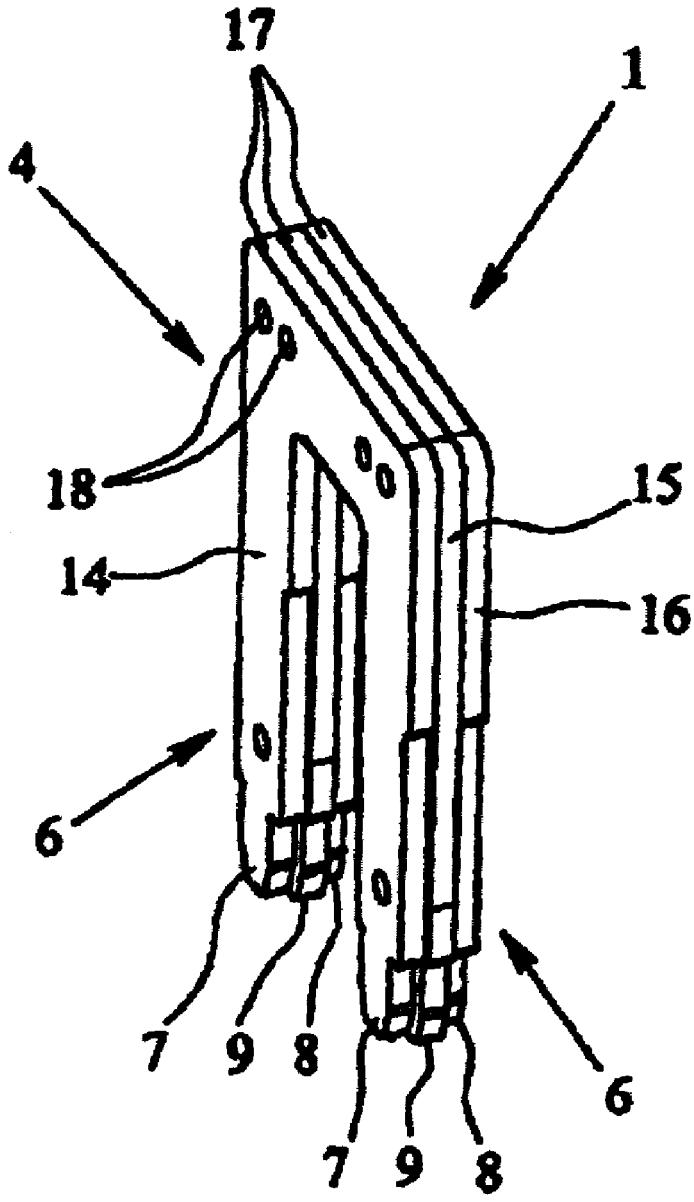
FIG. 6*b* shows a perspective individual view of the plug-in jumper of the present invention of FIG. 6*a* with an insulating head.

As is especially apparent in FIG. 6*b*, the jumper bar 4 of one plug-in jumper 1 consists of three jumper bar segments 14, 15, 16 arranged parallel to one another and made essentially identical. Each jumper bar segment specifically has one bar strip segment 17 and two contact legs 7, 8, 9 which are connected to the bar strip segment 17. In order to ensure exact positioning and reliable holding when the individual jumper bar segments 14, 15, 16 are connected, the jumper bar segments 14, 15, 16 which adjoin one another are held together by form-fit. To do this, the individual jumper bar segments 14, 15, 16 each have journals and corresponding holes 18 in which the journals of an adjoining jumper bar 14, 15 engage.

For additional safeguarding of the connection of the individual jumper bar segments 14, 15, 16 and for electrical insulation, the plug-in jumper 1 has an insulating head 19 which extends over the bar strip 5 as shown in FIG. 6*a*. In the insulating head 19, which sits frictionally tight on the bar strip 5, there is a recess 20 which runs in the lengthwise direction L which can be used to pull out or disengage the plug-in jumper 1 using the tip of a screwdriver.

The invention claimed is:

1. A plug-in jumper for elastic engagement in openings in busbars and for electrical contact-making of busbars of at least two electrical junction and/or connecting terminals located side by side comprising:

a jumper bar having a bar strip and at least two plugs projecting from the bar strip, each of the at least two plugs having at least two contact legs located essentially parallel to one another, at least one of the at least two contact legs being elastic, the contact legs being connected to form a plug that engages a respective busbar opening, the plugs including at least two contact areas located on top of one another for contact-making with said busbars of the two electrical junction and/or connecting terminals located side by side when the plugs are inserted into the openings of the busbars, said busbars being located on different planes from one another, and wherein the at least two contact areas include an upper contact area and a lower contact area, the width of the lower contact area being smaller than the width of the upper contact area.

2. The plug-in jumper of claim 1, wherein the at least two plugs have widths that are different from one another.

3. The plug-in jumper of claim 1, wherein spring forces of the plugs and contact legs are pointed parallel to a lengthwise direction of the bar strip upon insertion into the openings and upon contact-making with the busbars.

4. The plug-in jumper of claim 1, wherein each plug has three contact legs arranged essentially parallel to one another, at least a middle contact leg of the three contact legs being elastic.

5. The plug-in jumper of claim 4, wherein the middle contact leg is aligned offset from the other two contact legs.

6. The plug-in jumper of claim 1, wherein at least one of the at least two contact legs includes a lengthwise slot.

7. The plug-in jumper of claim 4, wherein the middle contact leg includes a lengthwise slot.

8. The plug-in jumper of claim 7, wherein said middle contact leg includes an upper contact area and a lower contact area, the lengthwise slot extending from an area generally above the lower contact area to an area generally above the upper contact area.

9. The plug-in jumper of claim 1, wherein one of the contact legs includes a width greater than its thickness.

10. The plug-in jumper of claim 4, wherein the at least two contact areas includes an upper contact area and a lower contact area, each of the three contact legs having a ramp bevel underneath the lower contact area.

11. The plug-in jumper of claim 1, wherein the jumper bar includes at least two jumper bar segments arranged essentially parallel to one another, each of the at least two jumper bar segments having a bar strip segment and several contact legs connected to the bar strip segment.

12. The plug-in jumper of claim 11, wherein the jumper bar segments are held together by form-fit.

13. The plug-in jumper of claim 12, wherein the jumper bar segments are riveted to one another.

14. The plug-in jumper of claim 1, wherein at least the bar strip is surrounded by an insulating head.

* * * * *